United States Patent [19]

Diebold et al.

[11] Patent Number: 4,620,795

[45] Date of Patent: Nov. 4, 1986

[54] FLUIDIZING DEVICE FOR SOLID PARTICULATES

[75] Inventors: James P. Diebold, Lakewood; John W. Scahill, Golden, both of Colo.

[73] Assignee: The United States of America as represented by the United States Department of Energy, Washington, D.C.

[21] Appl. No.: 625,327

[22] Filed: Jun. 27, 1984

Related U.S. Application Data

[63] Continuation-in-part of Ser. No. 457,339, Jan. 12, 1983, abandoned.

[51] Int. Cl.[4] ..... B01F 11/00; B65G 1/00; G01F 11/00

[52] U.S. Cl. ..... 366/241; 414/324; 222/228; 222/229

[58] Field of Search ..... 222/228, 241, 238, 239, 222/406, 410, 412, 414, 226, 229; 241/277, 301; 414/297, 301, 324; 366/241

[56] References Cited

U.S. PATENT DOCUMENTS

| | | | |
|---|---|---|---|
| 2,228,421 | 1/1941 | Taylor | 414/324 X |
| 2,561,258 | 7/1951 | Wolf | 222/406 |
| 2,576,620 | 11/1951 | Martin | 222/228 |

FOREIGN PATENT DOCUMENTS

| | | | |
|---|---|---|---|
| 1008176 | 1/1956 | Fed. Rep. of Germany | 366/241 |
| 167978 | 3/1934 | Switzerland | 414/301 |
| 885695 | 12/1961 | United Kingdom | 414/301 |
| 668859 | 6/1979 | U.S.S.R. | 222/229 |

*Primary Examiner*—Joseph J. Rolla
*Assistant Examiner*—Gregory L. Huson
*Attorney, Agent, or Firm*—Kenneth L. Richardson; Michael J. Higgins; Judson R. Hightower

[57] ABSTRACT

A flexible whip or a system of whips with novel attachments is suspended in a hopper and is caused to impact against fibrous and irregularly shaped particulates in the hopper to fluidize the particulates and facilitate the flow of the particulates through the hopper. The invention provides for the flow of particulates at a substantially constant mass flow rate and uses a minimum of energy.

13 Claims, 13 Drawing Figures

FLUIDIZING DEVICE FOR SOLID PARTICULATES

CONTRACTUAL ORIGIN OF THE INVENTION

The Unites States Government has rights in this invention under Contract No. EG-77-C-01-4042 between the U.S. Department of Energy and the Solar Energy Research Institute. a Division of Midwest Research Institute, Contract No. EG-77-C-01-4042 was renewed under Contract No. DE-AC02-83CH10093 Oct. 1, 1983.

This is a continuation-in-part of an application having Ser. No. 06/457,339, filed Jan. 12, 1983 and now abandoned.

BACKGROUND OF THE INVENTION

1. FIELD OF THE INVENTION

The present invention relates to an apparatus for facilitating a flow through a hopper of solid particulates and pertains more particularly to an apparatus for facilitating a flow through a hopper of fibrous or irregularly shaped solid particulates at a substantially constant mass flow rate.

2. DESCRIPTION OF THE PRIOR ART

It is a common industrial procedure to have solid particulate feed material flow through a hopper. In a typical hopper system, an auger at a bottom of the hopper rotates to deliver feed material through an orifice. Ideally, a rate at which the auger turns determines a flow rate of the feed material. A mechanical agitator may be used to fluidize particulates above the auger. Ideally, the feed material is of uniform bulk density and flows through the hopper with a constant mass flow rate. These ideal conditions are very difficult to attain, especially with material that is fibrous or irregularly shaped such as wood flour or sawdust. These materials have a high angle of repose and tend to form self-supporting stable arches above the agitator while the fluidized solids at the auger are depleted, so that the mass flow rate through the auger decreases and eventually approaches zero. Alterntively, the arch may collapse and form a vertical "chimney" in the particulate, whose walls are self-supporting, giving rise to the same difficulty.

Various devices have been used to break up the arches and chimneys. These devices have typically involved agitation of the hopper or large proportions of the hopper contents or both. For example, a vertical shaft inside the hopper may be provided with a plurality of horizontal rods distributed along a length of the shaft, and the entire apparatus may be vibrated or rotated to prevent agglomeration of the feed material. Another device provides bladders inside the hopper that are inflated to collapse a bridge formed in the feed. Both of these devices generally require undesirably large quantities of energy to work properly. Furthermore, in hoppers in which the auger speed is electronically controlled to be responsive to the mass flow rate, extreme agitation can disrupt a normal operation of the electronic system.

SUMMARY OF THE INVENTION

It is thus one object of the invention to provide an apparatus to facilitate a flow of particulate solids through a hopper.

It is another object of the invention to provide an apparatus to facilitate a flow of fibrous or irregularly shaped particulate solids through a hopper.

It is still another object of the invention to provide an apparatus to facilitate a flow of fibrous or irregularly shaped particulate solids through a hopper at a substantially constant mass flow rate.

It is yet another object of the invention to provide an apparatus to facilitate a flow of fibrous or irregularly shaped particulate solids through a hopper that will consume a minimal amount of energy.

Additional objects, advantages, and novel features of the invention will be set forth in the following description.

In accordance with the present invention, a flexible whip is supportedly connected at one end to a shaft that extends from a rotary motor that is positioned at a top of a hopper and over an auger. The flexible whip is designed so that when the shaft is rotated by the rotary motor the whip will move in such a manner that it expands out to impact against solid particulate feed matter in the hopper, thus fluidizing solids around any arches or chimneys that might have begun to form. This results in a substantially constant mass flow rate. Because only a small portion of the particulate feed material is fluidized at a time, the invention consumes a minimum amount of energy. The invention generally will not disrupt any auxiliary electronic systems that may otherwise operate with the hopper system.

DETAILED EXPLANATION OF THE PREFERRED EMBODIMENTS

Figure 1:
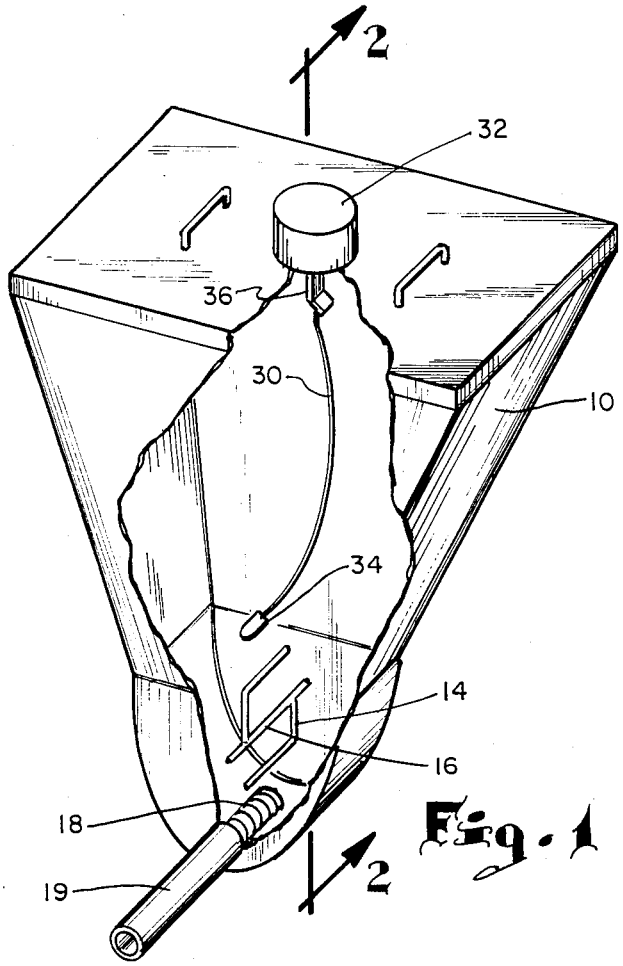
FIG. 1 is a partially broken-away perspective view, illustrating a placement of a first embodiment of the inventive apparatus in a typical hopper system before an addition of solid particulates.
Figure 2:
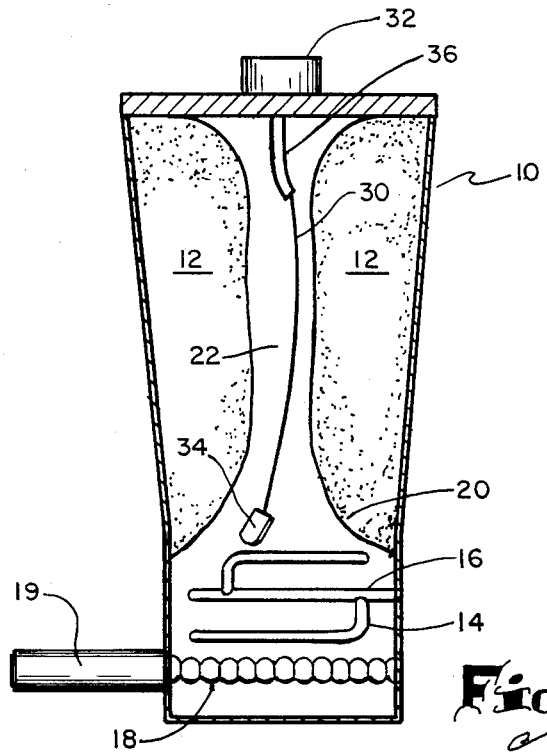
FIG. 2 is a cross-sectional view of the hopper system of FIG. 1, taken along line 2—2 of FIG. 1, illustrating the first embodiment of the inventive apparatus in the hopper system and a self-supporting arch and chimney formed by solid particulates therein.

Referring initially to FIGS. 1 and 2, there is shown a typical hopper system equipped with a first embodiment of the inventive device before the addition of solid particulates. Hopper 10 is provided with agitator 14, which rotates about its center rod 16 to fluidize particulate solids above auger 18. Auger 18 rotates to discharge particulates out of hopper 10 through pipe 19. As shown in FIG. 2, fibrous or irregularly shaped particulates 12 may pack together above agitator 14 to form self-supporting arch 20. It is apparent that a formation of arch 20 usually prevents a steady flow of particulate solids 12 to agitator 14. Arch 20 may partially collapse to form chimney 22. A sudden collapse will result in a nonuniform mass flow rate through the auger 18. Subsequent to the formation of chimney 22, heavy non-uniform chunks of particulate solid 12 may randomly fall down chimney 22 to agitator 14, further disrupting the mass flow rate by instantaneously changing a material bulk density.

These difficulties may be overcome by means of the instant invention. In the first embodiment of the invention, a whip 30 is suspended from rotary motor 32 into hopper 10 above agitator 14. The whip 30 is an elongated, flexible, resilient member capable of whiplike movement and can be made of spring wire, rubber, flexible plastic, or the like. Whip 30 may be connected to motor 32 by means of rigid shaft 36. Shaft 36 is preferably slightly bent so that whip 30 hangs obliquely with respect to a vertical. Whip 30 may be fitted with an anchor 34 for reasons to be discussed. The choice of material for anchor 34 is not crucial; for example, if whip 30 is a spring wire then anchor 34 may be a coiled spring.

Operation of motor 32 causes shaft 36 to rotate preferably between one and ten revolutions per second, so that anchor 34 transcribes a large, generally circular path within which path whip 30 and anchor 34 have eccentric, almost random movement. This movement causes whip 30 and anchor 34 to impact against walls of arch 20 and chimney 22, thus fluidizing the particulate solids 12 impacted upon and causing the walls to collapse. This promotes a substantially constant mass flow rate of particulate solids 12 to agitator 14 and auger 18.

Figure 3D:
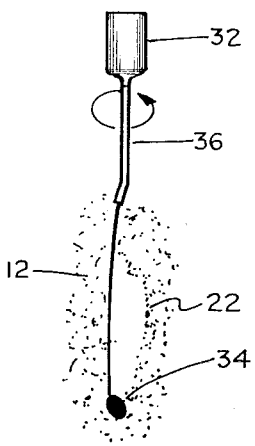
FIGS. 3*a*–3*d* are enlarged elevations of a pattern of movement of the first embodiment of the inventive apparatus within a hopper.
Figure 3C:
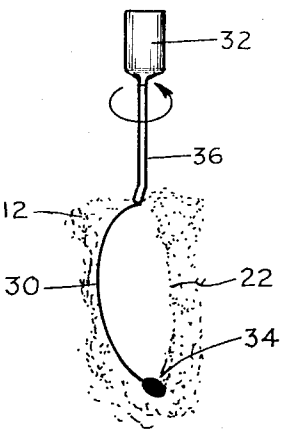
Figure 3B:
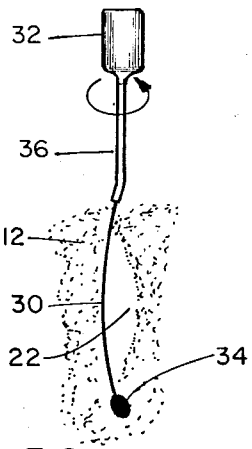
Figure 3A:
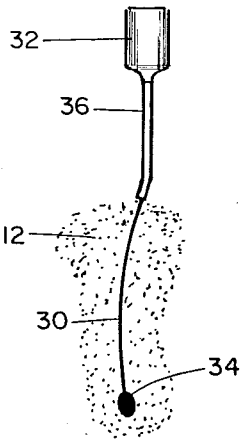

Operation of the first embodiment of the inventive device is illustrated in FIGS. 3*a*–3*d*. FIG. 3*a*shows whip 30 when motor 32 is not in operation. Whip 30 hangs obliquely and is surrounded by solids 12. FIG. 3*b*illustrates a motion of the apparatus when motor 32 is first turned on. Shaft 36 pulls whip 30 in a generally circular path. It may be seen that when whip 30 is initially surrounded by solids 12, its motion is severely dampened so that only a small diameter core of particulate solids 12 is fluidized. This fluidized core of solids is passed down to agitator 14 creating the vertical chimney 22 with a bottom of the chimney just above anchor 34. When the bottom level of the chimney falls below anchor 34, a damping action of the solids on whip 30 is lost and the amplitude of the whip movements increases so that whip 30 moves more eccentrically and randomly impacts the walls of chimney 22, as shown in FIG. 3*c*.

Each impact of whip 30 on the chimney walls typically dislodges a small amount of solids. These dislodged solids fall down to cover anchor 34 and a lower portion of whip 30, thus momentarily damping the movements of whip 30, as shown in FIG. 3*d*. It may be seen that FIGS. 3*b*and 3*d*illustrate essentially the same condition. In this manner, whip 30 is caused to alternate between undampened movements of large amplitude and damped movements of much smaller amplitude. This self-sustaining cycle maintains a relatively constant level of solids above agitator 14, resulting in a substantially uniform bulk density above auger 18 and a substantially constant mass flow rate at constant auger speed.

Using the first embodiment of the inventive apparatus in a hopper operating at a constant auger speed, 23 consecutive one-minute sample tests using −80 mesh pin flour resulted in a mass flow rate having a coefficient of variation of only 1%. Similar tests with prior art devices using the same feed gave a coefficient of variation of 2%. Thus, the inventive apparatus has the advantage of delivering a substantially constant mass flow at constant auger speed.

Figure 4:
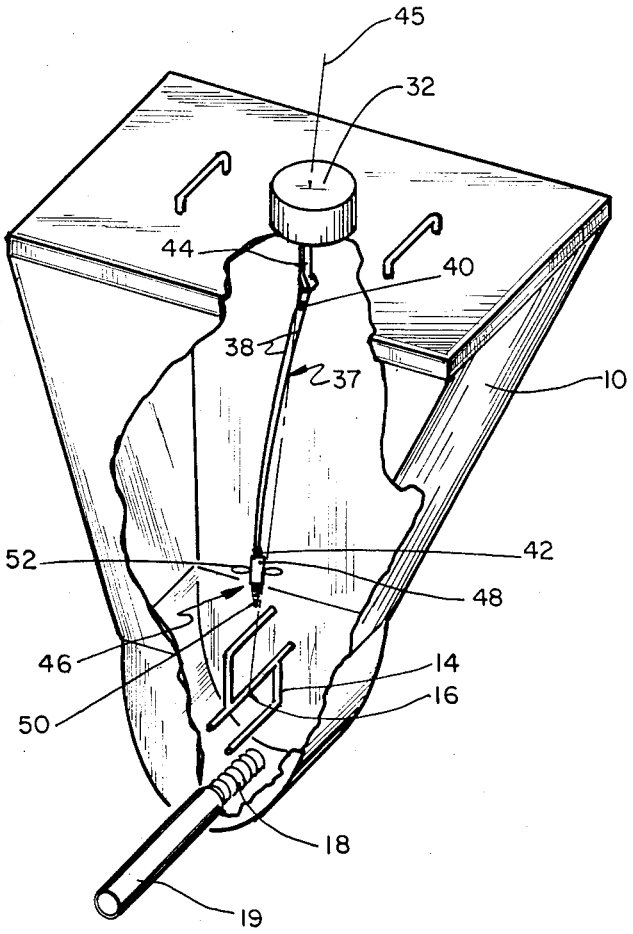
FIG. 4 is a partially broken-away, perspective view, illustrating a placement of a second embodiment of the inventive apparatus in a typical hopper system before an addition of solid particulates.

FIG. 4 shows a second embodiment of the present invention in a hopper system 10 before the addition of solid particulates 12. Hopper 10 is provided with agitator 14, which rotates about its center rod 16 to fluidize particulate solids above auger 18. Auger 18 rotates to discharge particulates out of hopper 10 through pipe 19. A modified whip 37 is suspended from a rotary motor 32 so as to extend longitudinally therefrom and into hopper 10 above agitator 14.

The whip 37 comprises two transversely spaced flexible elongated members 38 and may be made of cable such as that used in connection with automobile speedometers. Although whip 37 preferably comprises two flexible members 38, be it understood that whip 37 is not limited to only two flexible members and may comprise several flexible members or only one flexible member, as will occur to those skilled in the art. In the preferred construction the two elongated members 38 are approximately the same weight and are suitably connected together close to a top end 40 and a bottom end 42 of whip 37, as illustrated in FIG. 4. An even distribution of whip weight on each side of an imaginary vertically extending center line 45 provides stability during operation of the invention and less wear thereon, as will be more fully discussed hereinafter.

In a preferred attachment to motor 32, whip 37 is connected at its top end to motor 32 by means of a rigid shaft 44 that may extend vertically downwardly from motor 32. The bottom end of whip 37 is preferably provided with a modified anchor 46.

In this regard, anchor 46 may comprise a rigid longitudinal member 48, a spiral member 50, and a propeller member 52 having at least two blade elements, as is clearly shown in FIG. 4. The longitudinal member 48 is attached to the bottom end of whip 37 and should be of sufficient weight to cause whip 37 to hang substantially vertical when the invention is not in operation. By way of example, the longitudinal member 48 may be in the form of a short section of metal pipe.

A spiral member 50 is attached to the bottom end of longitudinal member 48. The spiral member 50 functions to burrow and to be buried within the solid particulates 12, as well as to substantially prevent anchor 46 from rising from the particulates 12 during burrowing. By way of example, spiral member 50 may be in the form of a carpenter's wood bit whose tip and sharp edges have been ground off. The spiral member 50 is connected to whip 37 through longitudinal member 48 and propeller members 52 such that whip 37 imparts a rotational movement to spiral member 50 during the rotation of whip 37. A radius and a pitch of the spirals should be large enough to enable the rotating spiral member 50 to bore into a desired size of the solid particulates 12 to be processed within hopper 10.

The propeller members 52 are perpendicularly affixed to the outside of longitudinal member 48 in such a manner that longitudinal member 48 is caused to hang vertically when the invention is not in operation. Additionally, propeller members 52 in conjunction with longitudinal member 48 keep spiral member 50 oriented such that spiral member 50 burrows upon contact with the surface of the solid particulates 12 and points in a generally vertical direction towards auger 18 when spiral member 50 is free of contact with particulates 12, as whip 37 is being driven by motor 32, which will be more fully explained hereinafter.

Figure 5F:
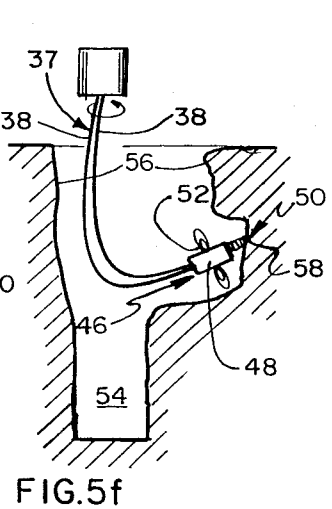
FIGS. 5*a*–5*f* are enlarged elevations of a pattern of movement of the second embodiment of the inventive apparatus within a hopper.
Figure 5E:
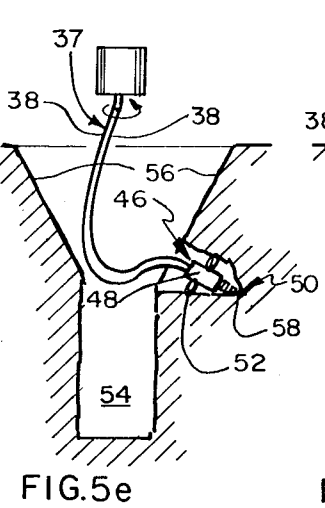
Figure 5D:
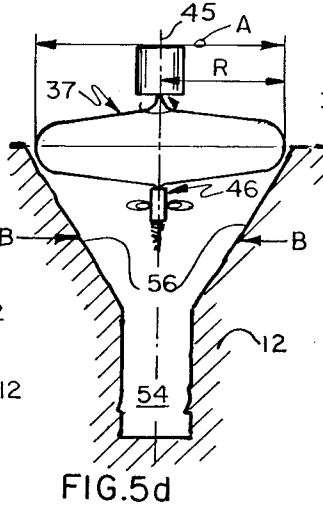
Figure 5C:
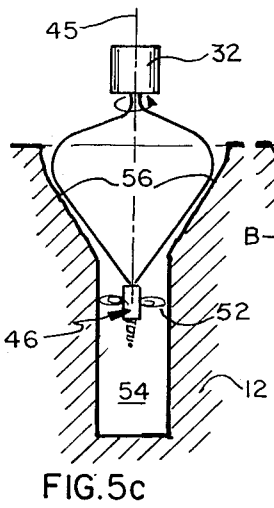
Figure 5B:
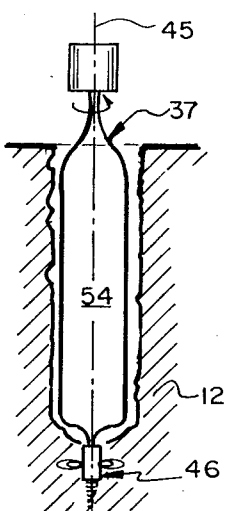
Figure 5A:
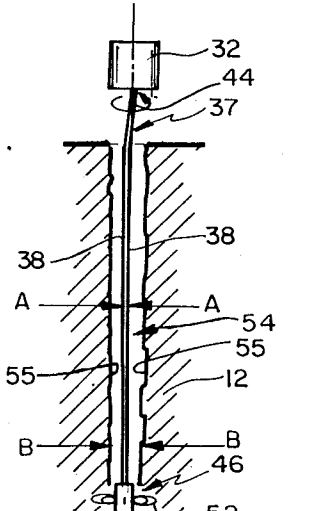

The operation of the second embodiment of the inventive device is illustrated in FIGS. 5*a*–5*f*. FIG. 5*a*- shows the whip 37 moving through solid particulates 12 shortly after operation of motor 32 is initiated. The motor 32 causes shaft 44 to rotate at a preferred speed of between about 1 and 10 revolutions per second. It will be noted that an optimum rotational speed will depend upon a specific application. The rotation of shaft 44 imparts a circular movement to whip 37, which, in turn, enables propeller members 52 to rotate, and also imparts circular movement to spiral member 50. When whip 37 is initially surrounded by solid particulates 12 its rotational motion is severly dampened. Consequently, only a small diameter core of particulate material is fluidized by the two transversely spaced elongated flexible members 38.

Under the latter conditions, as is best shown in FIG. 5*a*, the two flexible members 38 initially rotate together without a substantial change in the transverse distance between them. During such rotation, a weight of anchor 46 initially keeps whip 37 in a substantially vertical position. Thus, a diameter A defined by the independent circular path of each one of the two rotating flexible members 38 is fairly small. As the solid particulates 12 are fluidized and flow downward to agitator 14, an elongated vertical chimney 54 having transversely spaced walls 55 and a diameter B is normally created within the agitated particulate material 12 within the hopper 10. It is evident that diamter A corresponds to the aforesaid small diameter B of the particulate material fluidized by the circular movement of each one of the two flexible members 38 independently impacting the particulate material 12, when whip 37 is initially surrounded by the solid particulates 12.

During further fluidization of the solid particulates 12, each subsequent impact of whip 37 on chimney walls 55 dislodges additional small amounts of solid particulates 12. These dislodged particulates 12 fall down chimney 54 and momentarily cover anchor 46 and the lower portion of whip 37 until agitator 14 can pass them on to auger 18 and out of hopper 10, as is best shown in FIG. 5*b*.

Notably, when the particulate level drops below propeller members 52, as is best shown in FIG. 5*c*, a frictional drag of anchor 46 and elongated members 38 is drastically reduced. Such a reduction, enables motor 32 to increase the rotational velocity of the two elongated members 38. The increase in velocity coupled with the effects of centrifugal forces acting on whip 37 eventually causes the two flexible members 38 to transversely separate from one another.

Referring now to FIG. 5*d*, as each member 38 separates, its radius R, with respect to center line 45, increases as the rotational velocity of whip 37 increases. Consequently, the diameter of rotation A of whip 37 also increases and a horizontal level of anchor 46 with respect to a horizontal level of, for example, agitator 14 is caused to rise. Conversely, a decrease in the rotational velocity of whip 37 results in a decrease in the effects of the centrifugal forces acting on whip 37 and a decrease in the whip diameter of rotation A, as well as a lowering of the horizontal level of anchor 46.

It will now be apparent that increases in whip diameter of rotation A and the whip horizontal levels enable each rotating elongated member 38 to independently impact increasingly larger diameter and higher regions of particulate material 12. The ability of members 38 to impact increasingly larger diameter and higher regions of particulate material 12 with corresponding increases in rotational velocity allows whip 37 to increase chimney diameter B at progressively higher horizontal levels. It will be noted that high horizontal levels are defined as those levels whereby elongated members 38 and anchor 46 are rotating freely. Levels less than the aforesaid are defined as low horizontal levels. Also, high velocities are defined as those velocities associated with 5–10 revolutions per second, while low velocities are associated with less than five revolutions per second. Eventually, as is clearly illustrated in FIGS. 5*c*–5*e*, the increasing separation of the rotating elongated members 38 causes additional fluidization of the solid particulates 12 located near an upper surface of the particulate material, such that a funnel-shaped opening 56 to chimney 54 results.

After the funnel-shaped opening 56 has been created and the elongated members 38 and anchor 46 are rotating freely, slight imbalances imparted to whip 37 by the rotational movement of propeller members 52 cause elongated members 38 and anchor 46 to swing more randomly outward until anchor 46 impacts the wall-like boundaries of opening 56, as is best depicted in FIGS. 5*e*and 5*f*. Upon such impact, the rotational velocity of the elongated members 38 rapidly decreases, thereby allowing the rotating spiral member 50 to burrow into the particulate material 12 of opening 56. Thereafter, the burrowing spiral member 50 together with the rotating propeller members 52 bore a new or different chimney, as well as cause further fluidization.

In view of the above, it will be noted that longitudinal member 48 aids in the burrowing of spiral member 50 by keeping a tip end 58 thereof oriented downward or into the surface of the particulate material so that the burrowing can be initiated. The rotating propeller members 52 also aid spiral members 50 to burrow by substantially preventing anchor 46 from lying flat on the particulate surface, as is clearly shown in FIGS. 5*e*and 5*f*. It will be also noted that the increases and decreases in rotational velocity of whip 37 primarily occur because the amount of friction between the particulates 12 and the propeller members 52 and/or the elongated members 38 is sufficient to respectively decrease or increase the rotational speed of the small motor 32. Thus, the present invention is self-regulating in that motor 32 automatically adjusts the rotational velocity of whip 37 in response to the amount of frictional force acting on whip 37 and anchor 46, without a need for a speed regulating device.

From the aforesaid, it will now be appreciated that the use of two flexible members 38 in conjunction with anchor 46 yields several advantages in operation of the second embodiment of the invention. A few examples of these advantages are as follows: The use of two equally weighted elongated flexible members 38 as a whip means provides stability and thereby a mechanically balanced system during rotation which desirably reduces wear on shaft bearings within motor 32. The rotating propeller members 52 orient spiral member 50 in a manner that enables spiral member 50 to bite in and burrow into the solid particulates 12 upon impact therewith. The spiral member 50 upon being rotated by whip 37 is caused to bore into the funnel and arch-shaped regions of the particulate matter and thereby substantially fluidize and eliminate such regions. The anchor 46 at fairly low velocities desirably maintains the two transversely spaced elongated flexible members 38 vertically oriented so as to enable each member 32 to independently impact fairly narrow, transversely spaced walls of the chimney 55. The impact action of the two transversely spaced elongated members 38 and the burrowing action of anchor 46, in conjunction with the self-adjusting velocity feature of the inventive device, provides substantial steady fluidization of the solid particulates 12, and therefore a relatively constant supply of solid particulates 12 to agitator 14 and auger 18. The latter advantage obviates a need for complex electronic or mechanical regulating systems to vary the auger speed in order to compensate for variations in mass flow rate. The operation of the present invention normally advantageously requires minimal energy since only a small amount of the solids are fluidized at a time, which is in sharp contrast to some conventional hopper systems that attempt to fluidize the entire solid contents of the hopper. Lastly the apparatus has a relatively small physical effect on the hopper system so there is little chance for interference with other mechanical or electrical systems that may operate within the hopper.

Various changes and modifications, as will be evident to those skilled in the art, may be introduced in the foregoing practices without departing from the invention. Thus, the particularly illustrated embodiments set forth above were chosen and described in order to best illustrate the principles of the invention and its practical application, rather than to limit the invention to the precise form disclosed.

The embodiments of the invention in which an exclusive property or privilege is claimed are defined as follows:

1. An apparatus for facilitating a flow of solid particulates through an orifice of a hopper comprising:

(a) a flexible whip including two transversely spaced elongated members, said two elongated members being connected to one another at opposed ends thereof;

(b) means for mounting said whip in a generally vertical orientation within said hopper such that one end of said whip is freely suspended above said orifice;

(c) means for causing said whip to rotate about a substantially vertical axis defined by said hopper such that each one of said two elongated members are caused to independently impact and fluidize said solid particulates within said hopper, and wherein an anchor is affixed to the freely suspended end of said whip, and wherein said anchor comprises:

(i) a rigid longitudinal member having a first and a second end, said first end being connected to said freely suspended end of said whip; and (ii) a spiral member which is supportedly connected to said second end of said longitudinal member.

2. The apparatus of claim 1, wherein said means for causing the rotation of said whip is a rotary motor coupled to said mounting means.

3. The apparatus of claim 1, wherein said means for mounting said whip comprises a substantially rigid shaft having opposed ends, one end of said shaft being attached to said whip and the other end of said shaft being attached to said rotary motor.

4. The apparatus of claim 1, wherein said anchor further comprises propeller means affixed to said longitudinal member.

5. The apparatus of claim 4, wherein said whip and said means for causing said whip to rotate are adapted to self-adjust a velocity at which said whip is said rotating.

6. The apparatus of claim 5, wherein a transverse distance between each one of said two elongated members increases as said rotational velocity of said whip increases and decreases as said rotational velocity of said whip decreases.

7. The apparatus of claim 6, wherein said whip extends longitudinally from said means for mounting said whip, and wherein revolutions of said whip define a first set of different diameters for a corresponding set of different low velocities and a second set of different diameters for a corresponding set of different high velocities, said second set of diameters being greater than said first set of diameters, and wherein said whip longitudinally extends to a first set of different horizontal levels for a corresponding set of different low velocities and extends to a second set of different horizontal levels for a corresponding set of different high velocities, said second set of horizontal levels being higher than said first set of horizontal levels.

8. An apparatus for facilitating a flow of solid fibrous or irregularly shaped particulates through an orifice of a hopper at a substantially constant mass flow rate, said apparatus comprising:

(a) a flexible whip;

(b) means for mounting said whip in a generally vertical orientation within said hopper so that one end of said whip is freely suspended above said orifice;

(c) means for causing said whip to revolve about a substantially vertical axis within said hopper, said revolving whip impacting and dislodging said solid particulates within said hopper;

(d) an anchor means, said anchor means being adapted to maintain said whip in a substantially vertical position while said whip is caused to revolve, said anchor means being further adapted to burrow in said particulates and said dislodge said solid particulates to aid said whip in causing said particulates to flow through said orifice at a substantially constant mass flow rate, and wherein said whip and said means for causing said whip to revolve are adapted to self-adjust a velocity at which said whip is said revolving, and, wherein said whip extends longitudinally from said means for mounting said whip, and wherein revolutions of said whip define a first set of different diameters for a corresponding set of different low velocities and a second set of different diameters for a corresponding set of different high velocities, said second set of diameters being greater than said first set of diameters, and wherein said anchor extends at a first set of different horizontal levels for a corresponding set of different low velocities and extends at a second set of different horizontal levels for a corresponding set of different velocities, said second set of horizontal levels being higher than said first set of horizontal levels, and wherein said anchor comprises:

(i) a rigid longitudinal member for maintaining said whip in a substantially vertical orientation while revolving at said low velocities, said longitudinal member having a first and a second end, said first end being connected to said freely suspended end of said whip; and (ii) a spiral member for biting and said burrowing into said particulates, said spiral member being supportedly connected to said longitudinal member.

9. The apparatus of claim 8, wherein said means for causing said whip to revolve about a substantially vertical axis is a rotary motor coupled to said mounting means.

10. The apparatus of claim 8, wherein said means for mounting said whip comprises a substantially rigid shaft having opposed ends, one end of said shaft being attached to said whip and the other end of said shaft being attached to said rotary motor.

11. The apparatus of claim 8, wherein said flexible whip includes two elongated flexible members.

12. The apparatus of claim 8, wherein said anchor further comprises propeller means for impacting upon and dislodging said particulates and for orienting said spiral member such that said spiral member is substantially always enabled to said bite and burrow into said particulates at said high velocities, said propeller means being affixed to said longitudinal member.

13. An apparatus for facilitating a flow of solid particulates through an orifice of a hopper comprising:

(a) a flexible whip including at least two transversely spaced elongated members, said at least two elongated members defining first and second pairs of longitudinally spaced opposed terminal ends;

(b) means for mounting said whip in a generally vertical orientation within said hopper such that one end of said whip is freely suspended above said orifice, said means for mounting said whip being adapted to couple said at least two elongated members at one of said first and second pairs of opposed terminal ends;

(c) means for causing said whip to rotate about a substantially vertical axis defined by said hopper such that each one of said two elongated members are caused to independently impact and fluidize said particulates within said hopper; and (d) an anchor for burrowing into said solid particulates, said anchor being affixed to the freely suspended end of said whip so as to couple said at least two elongated members at a remaining one of said first and second pairs of opposed terminal ends, said coupling of said first and second pairs of terminal ends of said two elongated members enabling each one of said at least two elongated members along a region extending longitudinally between said coupled first and second pairs of opposed terminal ends to independently impact and fluidize said particulates when said whip is being caused to rotate, and wherein during the rotation of said whip a transverse distance between each one of said two elongated members increases as a rotational velocity of said whip increases and decreases as said rotational velocity of said whip decreases.

* * * * *